US005265357A

United States Patent [19]

Yu

[11] Patent Number: 5,265,357

[45] Date of Patent: Nov. 30, 1993

[54] MAGIC 3D EFFECT ENHANCING FRAME

[76] Inventor: Zhilong Yu, 12310 Herrington Manor Dr., Silver Spring, Md. 20904

[21] Appl. No.: 823,460

[22] Filed: Jan. 22, 1992

[51] Int. Cl.[5] ..... G09F 13/00

[52] U.S. Cl. ..... 40/152.2; 362/31

[58] Field of Search ..... 40/152.2, 541, 546, 40/564, 204; 362/23, 29, 26, 31, 98, 812

[56] References Cited

U.S. PATENT DOCUMENTS

| | | | |
|---|---|---|---|
| 2,579,230 | 12/1951 | Giboney | 40/204 |
| 2,677,909 | 5/1954 | Heydenryk | 40/152.2 |
| 3,318,032 | 5/1967 | Robison et al. | 40/152.2 |
| 4,791,540 | 12/1988 | Dreyer, Jr. et al. | 362/31 |
| 4,819,355 | 4/1989 | Solow | 40/204 |
| 4,922,384 | 5/1990 | Torrence | 40/152.2 |
| 4,974,354 | 12/1990 | Hembrook, Jr. | 262/31 |

*Primary Examiner*—Kenneth J. Dorner
*Assistant Examiner*—C. Hope Davis

[57] ABSTRACT

A picture frame unit is disclosed that is particularly useful for lighting displayable materials such as three dimensional photographs and two dimensional photographs. The unit is portable and includes an enhanced illumination planar display area. The unit also includes an illumination source mounted in front of the picture for creating an optical illusion to the eyes that the display area extends deeply into the frame unit.

5 Claims, 4 Drawing Sheets

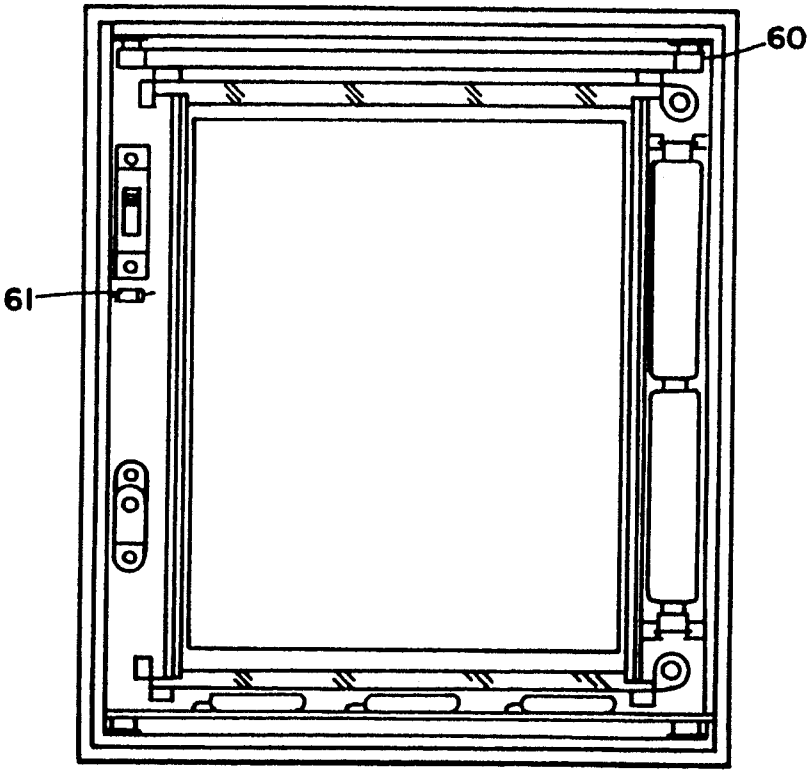
FIG. 10
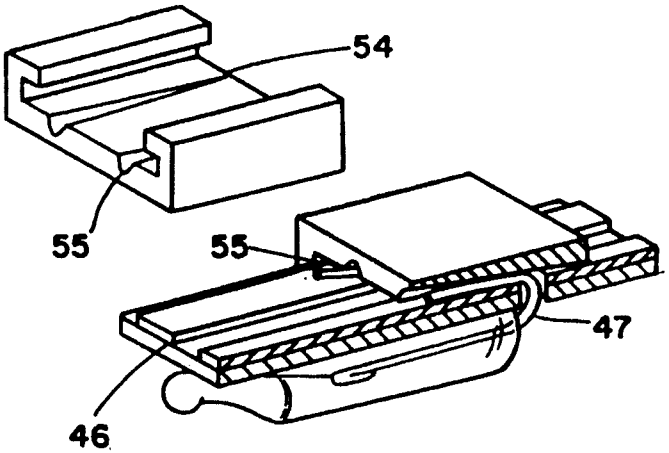
FIG. 5
FIG. 6
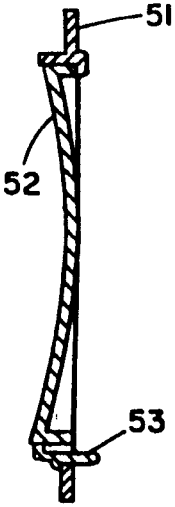
FIG. 7

MAGIC 3D EFFECT ENHANCING FRAME

BACKGROUND OF THE INVENTION

Since the introduction of the Victorian stereoscope, creators of 3D images have presented illusory images. Until today however, a 3D picture was not an available creation to the ordinary photographer. Accordingly, there has never been a need for addressing the mounting process of a 3D picture. With the introduction of the 3D camera for the amateur photographer, there is now a need for a frame to present a 3D image without loosing the illusory effect.

Ordinary picture frames for two dimensional pictures present a picture with the edges of the image in contact with the rim of the frame face against the glass or transparent cover. When a 3D picture is used in such a frame, the 3D effect becomes compressed as the details of the picture approach the edges. The illusory depth of the image is erased by the mount.

A review of prior image displays teaches that illuminated picture frames are well known. For example, Robison et al. U.S. Pat. No. 3,318,032 discloses an illuminated display frame having light diffusing transparent prismatic lists and a picture displayed in an outer frame mounted on the lists. Robison does not attempt to solve the problems created in mounting 3D pictures.

Other prior art mountings which teach the use of lights to illuminate pictures are disclosed in the patents to Reefe U.S. Pat. No. 2,549,928, Diceglie U.S. Pat. No. 4,096,656 and Torrence U.S. Pat. No. 4,922,384. The art of mounting 3D pictures is not addressed by any of these patents. Accordingly, there is a need for a picture frame specifically designed to enhance the magical effects displayed by a 3D picture .

DESCRIPTION OF THE DRAWINGS

FIG. 5 is a perspective view of the light and connector assembly.

FIG. 6 is a perspective view of a portion of the alternate connector.

FIG. 7 is a side view of the alternate back assembly as assembled.

FIG. 10 a rear view of the back section of an alternative back assembly.

DETAILED DESCRIPTION OF THE INVENTION

Figure 1:
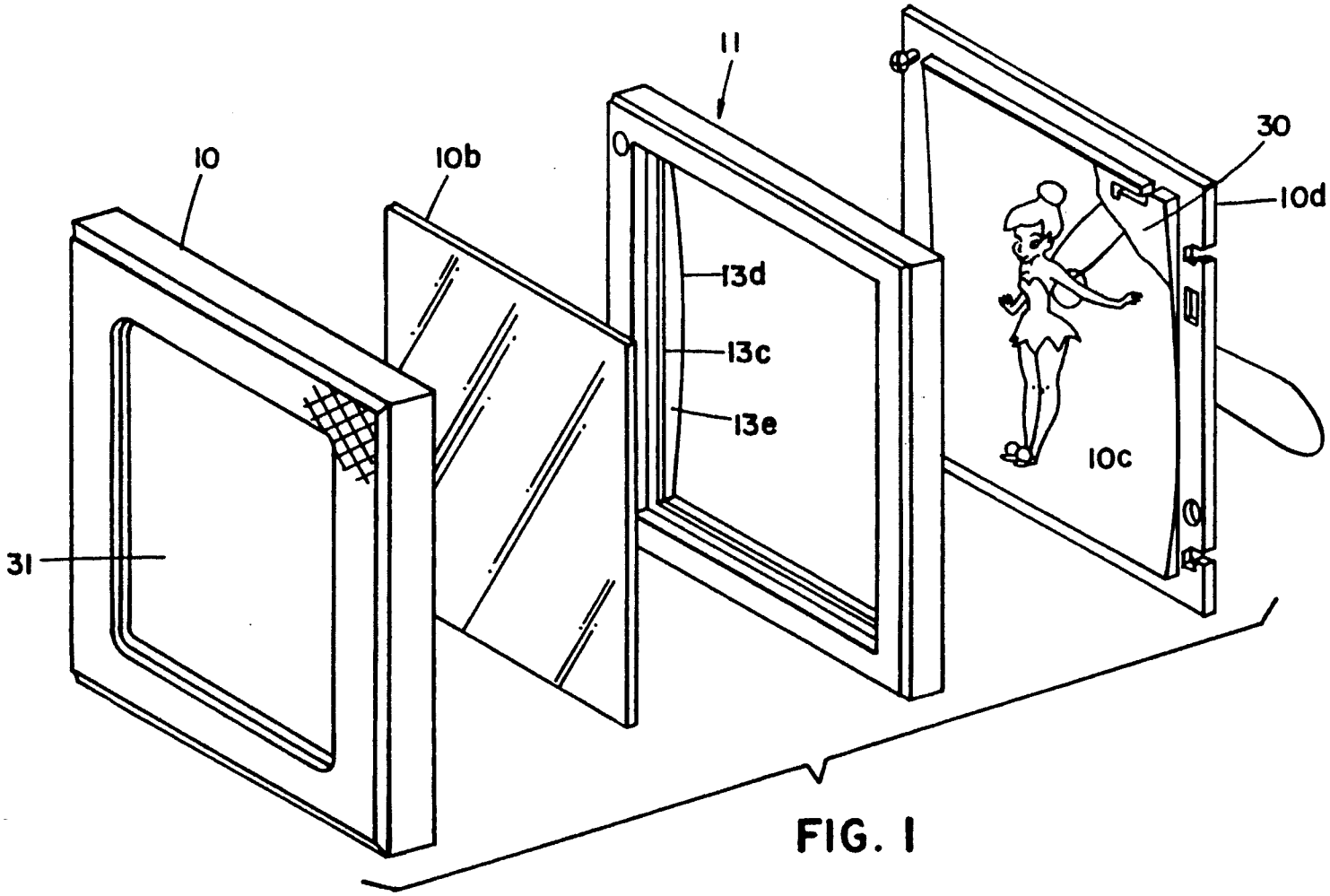
FIG. 1 is a perspective view of a lighted picture frame constructed in accordance with the present invention.

A preferred embodiment of a lighted picture frame assembly (10) constructed in accordance with the present invention will now be described with reference to the drawings.

With reference to FIGS. 1-4 the lighted picture frame assembly (10) includes an inner frame (11) of unitary molded construction made of opaque material such as polyester or phenolic plastics. The frame (11) has outer walls (12) and an inner walls (13) which form channels (14). Inner walls (13) include curved wall faces (**13*a*) (13*b*) inner edges (13*c*) and curved mirrored members (13*d*). The edges provide a partial covering for a 3D picture to enhance the depth for the viewer. The channel member 14 receives battery terminals 15, 15*a* and batteries 16, 16*a* which provide a power source. Inside wall 13*b* ends to form a gap (17) at the top and bottom of each side. The other side of the gap is formed by flange corner (18). The gap, which is formed at each inside wall end is used to support an end of an optical member (20). Optical members (20) are positioned along opposite sides of the frame and perpendicular to inside walls (13, 13*a***).

A plurality of lights (21) are mounted directly behind optical members (20). Each light is conductively attached to a printed circuit board by conductive members (22). Conductive wires not shown are used to connect each printed circuit board (23) with the terminal members (24) on each board. Each printed circuit board has an inner face painted white to enhance the illumination provided by the lights. Slots (25) are formed in the inner wall (12) of the frame for receiving and supporting each printed circuit board. Resilient metal devices (26) are also utilized to secure each printed circuit board. Each resilient device grounds the corresponding circuit board.

As further illustrated in FIGS. 1-4, filaments of the bulbs (21) located along each inside wall are arranged more or less on the focal line of the optic member. The optic member (20) of the preferred embodiment is a plano-convex cross sectioned acrylic bar adjacent the bulbs (21) to direct light rays on an incline downwardly and the throw the light onto the surface of 3D picture such that the small plastic semicylinders coated on the surface of the 3D picture are displayed with full effect.

Figure 4:
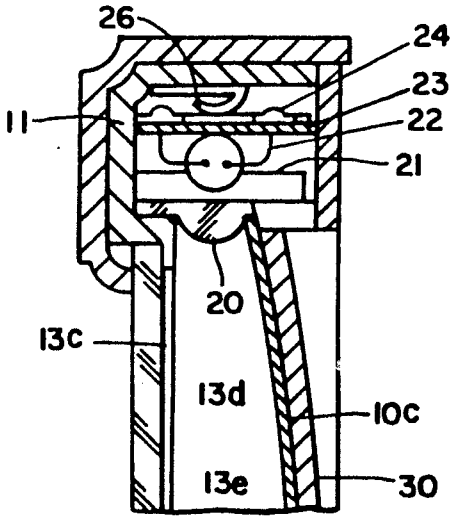
FIG. 4 is a cross sectional view of FIG. 2 taken along lines 2—2.

Turning back to FIG. 1, the assembly (10) includes an outer frame (**10*a*), a glass sheet (10*b*), an inner frame (11) a 3D picture (10*c*) and a back portion (10*d*). After assembly, the outer edges of the picture extend beyond the inner edges (13*c*) of the inner frame (11). Adjacent each inner edge (13*c*) is a curved mirror member (13*d*) which provides in part a curved support surface for the picture. Each curved wall has an inside face provided with a reflective surface (13*e*). Rear supporting surface (30) as illustrated in FIGS. 1 and 4** is wedge shaped at the top and bottom to provide a curved supporting surface.

The picture frame assembly this provides a portal opening 31 to support a 3D picture at least a distance of millimeters from the opening. The picture is supported by means that positions the picture at least a distance of three millimeters from the portal opening.

Figure 2:
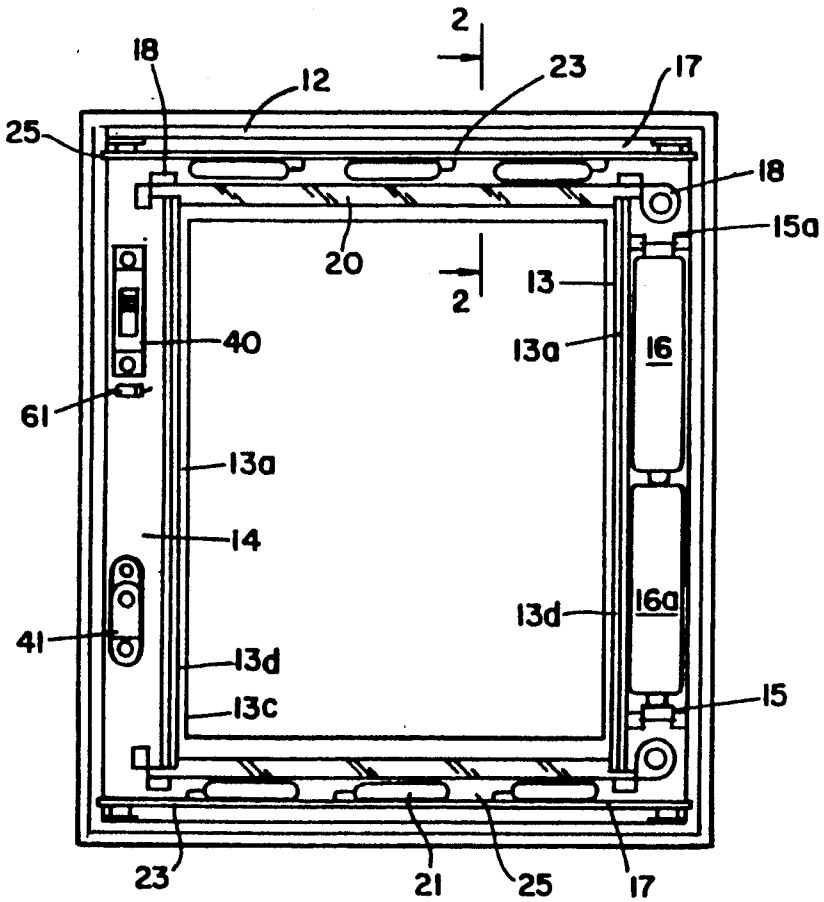
FIG. 2 is a back view of the inner frame.

As further shown in FIG. 2, the channel (14) includes a switch (40) and an external power supply plug (41). The plug permits use of the assembly without batteries and the switch electrically connects or disconnects the printed circuit boards to batteries or an external power source as is well known in the art. The switch also is fuctioned as a light dimmer by connecting a diode (61) serially to the bulbs. Through the electrical power the bulbs (21) are illuminated to display the 3D picture.

Figure 3:
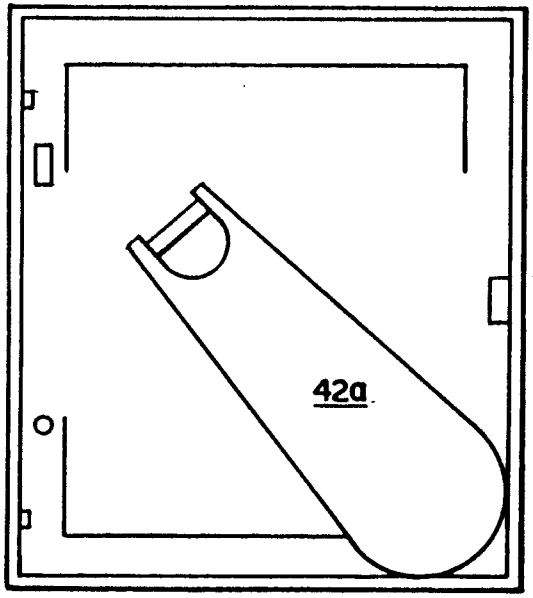
FIG. 3 is a back view of the back portion.

FIG. 3 illustrates the back portion 40 of the assembly, The back portion includes a stand 42.

In operation, the bulbs are illuminated to pass light through the optical members. The light reflects off the mirrors positioned along side of the 3D picture. The light reflects off the mirrors positioned along side of the 3D picture. The curved mounting supports for the picture along with the scattering light displays the picture and creates an image of added depth. The enhanced depth to the viewer is even further projected by the extended assembly. The back portion includes a stand 42.

FIGS. 5-6 further illustrate alternative details of the frame assembly. FIG. 5 discloses the use of flat conductors 46 that are connected to lamp leads 47 and held in a grooved channel 54. Tapered grooves 55 form a socket for the leads for attachment to the conductors 46.

Figure 9:
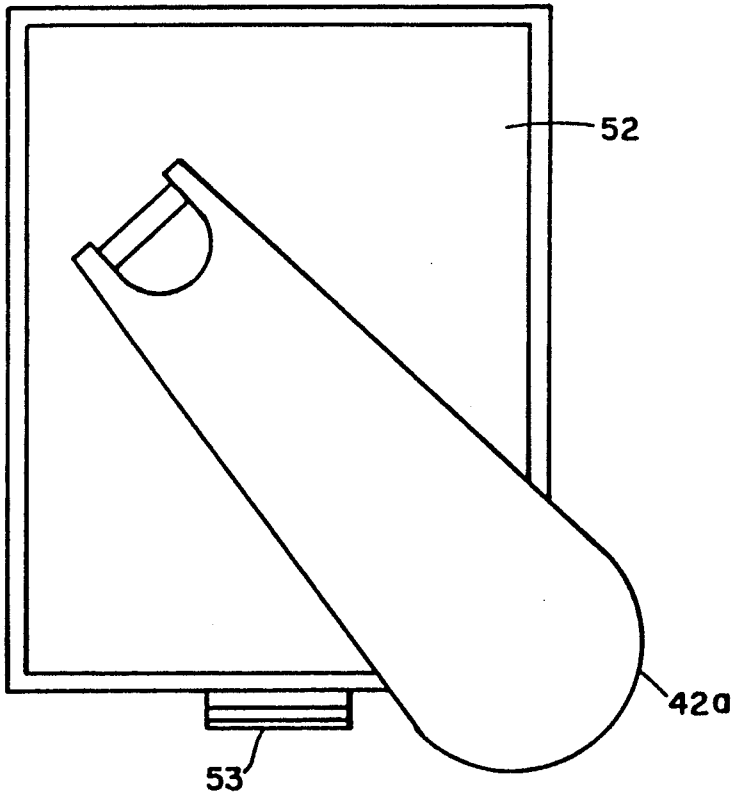
FIG. 9 is a rear view of the back.
Figure 8:
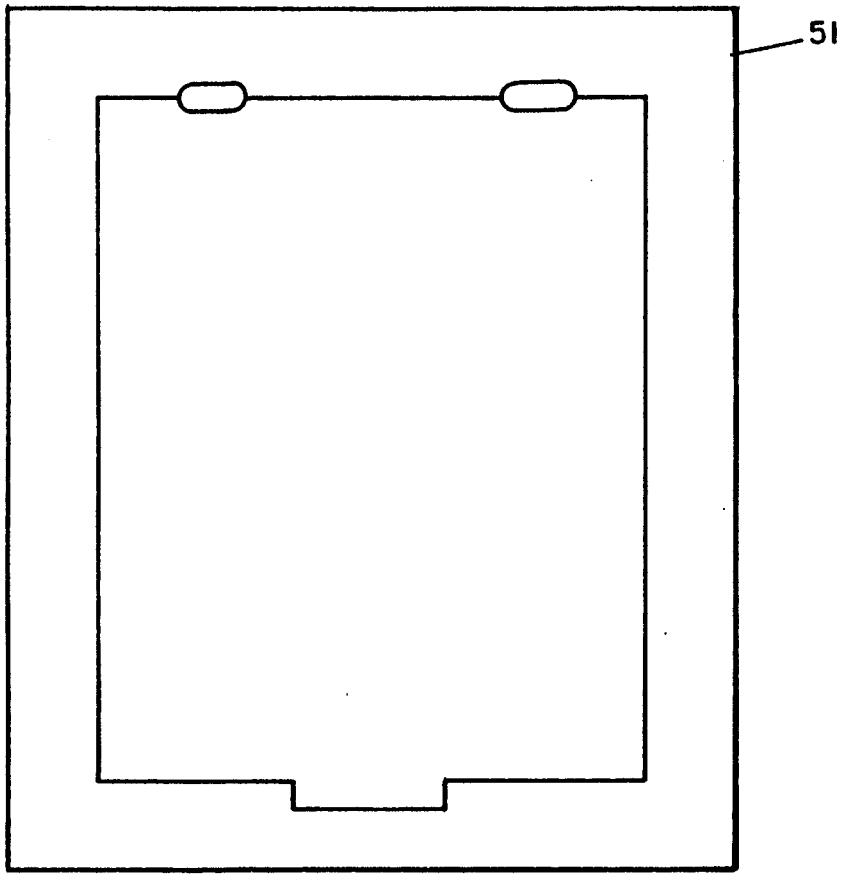
FIG. 8 is a rear view of the back view of the back section.

FIGS. 7-9 an alternative backing sections unassembled. FIG. 7 is a cross sectional view of FIGS. 8 and 9 in assembled form. FIG. 7 illustrates an outer back section 51 and a back 52. The section snap fit together as illustrated in FIG. 7. As shown in FIG. 9 stand 42*a* and tab 53 are formed integral with the back 52. Removal of back 52 permits changing of the picture.

FIG. 10 illustrates another embodiment of the frame assembly. The assembly includes a tubular bulb (60) used instead of the individual bulbs of the previous embodiments. The bulb is electrically connected to the power source without the use of the printed circuit board by conventional means.

I claim;

1. An illuminated picture frame assembly for a 3D picture, comprising;

a back portion, said back portion having a stand means for supporting said frame assembly in an upright position, an inner frame housing, said inner frame housing having two inside walls, each inside wall having an inner facing reflective surface and a support means for supporting said picture, said support means curved to form a curved support surface for said picture such that said picture conforms to a shape of said curve support surface while supported on said curved support surface, inner edge portions, said edge portions forming a portal opening for viewing said picture, said portal opening of smaller area that an are of said picture, at least two optical members extending along said inner edge portions, a plurality of spaced apart light sources within the inner frame housing, a power sources conductively connected to a printed circuit board for illuminating said light sources, and switching means adapted to close a circuit containing said power source and said light sources.

2. The illuminated picture frame of claim 1 further comprising, a rear support surface formed on a back portion surface for receiving a rear face of said picture, said rear support having a wedge shaped surface correspondingly mating with said curved support surface for supporting said picture.

3. The illuminated picture frame of claim 1 further comprising an outer frame, said outer frame including a glass sheet.

4. The illuminated picture frame of claim 1 further comprising picture support means for supporting said picture at least a distance of 3 millimeters from said portal opening.

5. The illuminated picture frame assembly of claim 1 further comprising tapered grooves formed in said inner frame, said grooves forming sockets to receive lamp leads for electrical attachments to conductors.

* * * * *